US006182385B1

(12) United States Patent
Knutson

(10) Patent No.: US 6,182,385 B1
(45) Date of Patent: Feb. 6, 2001

(54) ROCK AND MATERIAL LOADING SYSTEM

(75) Inventor: Kenneth O. Knutson, Toronto, SD (US)

(73) Assignee: Ken's Enterprises, Inc.

( * ) Notice: Under 35 U.S.C. 154(b), the term of this patent shall be extended for 0 days.

(21) Appl. No.: 09/360,577

(22) Filed: Jul. 26, 1999

Related U.S. Application Data

(60) Provisional application No. 60/094,172, filed on Jul. 27, 1998.

(51) Int. Cl.[7] ..... A01A 15/02; E02F 3/28

(52) U.S. Cl. ..... 37/442; 37/903; 172/197; 172/198; 172/200; 172/815; 172/664; 172/736; 172/748

(58) Field of Search ..... 37/442, 445, 449, 37/903, 342, 234, 270, 271; 172/785, 777, 778, 197, 198, 199, 200, 234, 815, 664, 665, 736, 738, 748

(56) References Cited

U.S. PATENT DOCUMENTS 2,029,122 * 1/1936 Stout, Jr. .
2,840,933 * 7/1958 Brem .
3,466,766 * 9/1969 Kahlbacher .
4,006,782 * 2/1977 Nishino et al. .
4,779,363 * 10/1988 Boutrais et al. ..... 172/815 X
5,664,348 * 9/1997 Omann ..... 37/903 X

* cited by examiner

*Primary Examiner*—Christopher J. Novosad
(74) *Attorney, Agent, or Firm*—Michael S. Neustel

(57) ABSTRACT

A rock and material loading system that is removably attachable to a loader bucket for loading material such as rocks into the loader bucket. The inventive device includes a pair of brackets attached to the upper rear portion of a loader bucket, a pair of lower jaws attached to the brackets, a pair of upper jaws pivotally attached to the lower jaws, an upper shaft securable within the jaws, a pair of side arms pivotally extending from the upper shaft, a lower shaft rotatably attached to the distal ends of the side arms, a plurality of teeth attached to the lower shaft, a pair of leverage arms attached to the lower shaft, and a pair of hydraulic cylinders attached to the upper shaft and to the leverage arms for manipulating the teeth. The user manipulates the hydraulics after engaging an object such as a rock for loading the rock into the conventional loader bucket. If the user requires usage of the loader bucket without the invention, the user simply opens the jaws and can easily remove the upper shaft from the jaws thereby allowing unobstructed use of the loader bucket.

20 Claims, 7 Drawing Sheets

ROCK AND MATERIAL LOADING SYSTEM

CROSS-REFERENCE TO RELATED U.S. PATENT APPLICATION

I hereby claim benefit under Title 35, United States Code, Section 119(e) of U.S. provisional patent application Ser. No. 60/094,172 filed Jul. 27, 1998. This application is a continuation of the Ser. No. 60/094,172 application. The Ser. No. 60/094,172 application is currently pending.

BACKGROUND OF THE INVENTION

1. Field of the Invention

The present invention relates generally to rock pickers and more specifically it relates to a rock and material loading system that is removably attachable to a loader bucket for loading material such as rocks into the loader bucket.

2. Description of the Prior Art

Rock picking devices have been in use for years. Typically, a conventional rock picker includes a frame, a hitch for attaching to a tractor, a storage bin pivotally attached to the frame for receiving the rocks, a plurality of rock picking arms that rotate about the frame thereby throwing the rocks into the storage bin, and a power take off (PTO) assembly attached to the rock picking arms for connecting to the PTO of the tractor. Alternative conventional rock pickers are similar to the previous rock-picking device, however they include a loader bucket that is hydraulically raised/lowered for throwing the rock into the storage bin of the rock picking device.

Conventional rock picking devices are fine for the use they are designed for. However, conventional rock picking devices are undesirable since the user must pull the structure behind the tractor. In addition, conventional rock picking devices tend to be relatively expensive because they are generally self-contained. In addition, conventional rock picking devices are undesirable since they are not useful for retrieving rocks deep within the surface of the earth.

An example of an attempt to solve the problem of conventional rock pickers is U.S. Pat. No. 5,664,348 to Omann. Omann teaches a rock and material loading apparatus having a plurality teeth pivotally supported about the front edge of a loader bucket. Omman further teaches a pair of knee members below the plurality of teeth for allowing the user to pivot the plurality of teeth by lowering the front edge of the bucket. Omman does not utilize any hydraulic cylinders or actuators for manipulating the plurality of teeth.

While these devices may be suitable for the particular purpose to which they address, they are not as suitable for being removably attachable to a loader bucket for loading material such as rocks into the loader bucket. Conventional rock picking devices require pulling the structure with a large tractor. In addition, conventional rock picking devices do not allow easy removal for allowing normal utilization of the loader bucket and tractor.

In these respects, the rock and material loading system according to the present invention substantially departs from the conventional concepts and designs of the prior art, and in so doing provides an apparatus primarily developed for the purpose of being removably attachable to a loader bucket for loading material such as rocks into the loader bucket.

SUMMARY OF THE INVENTION

In view of the foregoing disadvantages inherent in the known types of rock picking devices now present in the prior art, the present invention provides a new rock and material loading system construction wherein the same is removably attachable to a loader bucket for loading material such as rocks into the loader bucket.

The general purpose of the present invention, which will be described subsequently in greater detail, is to provide a new rock and material loading system that has many of the advantages of the rock picking devices mentioned heretofore and many novel features that result in a new rock and material loading system which is not anticipated, rendered obvious, suggested, or even implied by any of the prior art rock picking devices, either alone or in any combination thereof.

To attain this, the present invention generally comprises a pair of brackets attached to the upper rear portion of a loader bucket, a pair of lower jaws attached to the brackets, a pair of upper jaws pivotally attached to the lower jaws, an upper shaft securable within the jaws, a pair of side arms pivotally extending from the upper shaft, a lower shaft rotatably attached to the distal ends of the side arms, a plurality of teeth attached to the lower shaft, a pair of leverage arms attached to the lower shaft, and a pair of hydraulic cylinders attached to the upper shaft and to the leverage arms for manipulating the teeth. The user manipulates the hydraulics after engaging an object such as a rock for loading the rock into the conventional loader bucket. If the user requires usage of the loader bucket without the invention, the user simply opens the jaws and can easily remove the upper shaft from the jaws thereby allowing unobstructed use of the loader bucket.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a rock and material loading system that will overcome the shortcomings of the prior art devices.

Another object is to provide a rock and material loading system that is designed of a rigid and durable structure.

An additional object is to provide a rock and material loading system that is easily removed from a loader bucket.

A further object is to provide a rock and material loading system that is attachable to a conventional loader bucket without requiring significant modification to the loader bucket.

Another object is to provide a rock and material loading system that retains the rocks within the loader bucket while transporting the rocks.

A further object is to provide a rock and material loading system that is capable of utilizing a conventional skid loader thereby taking advantage of the ease of operation and versatility of these machines.

Another object is to provide a rock and material loading system that increases the load capacity of the conventional loader bucket.

A further object is to provide a rock and material loading system that allows a single individual to attach and remove from a loader bucket.

An additional object is to provide a rock and material loading system that allows rocks to be easily unloaded into an elevated structure such as a truck or trailer.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
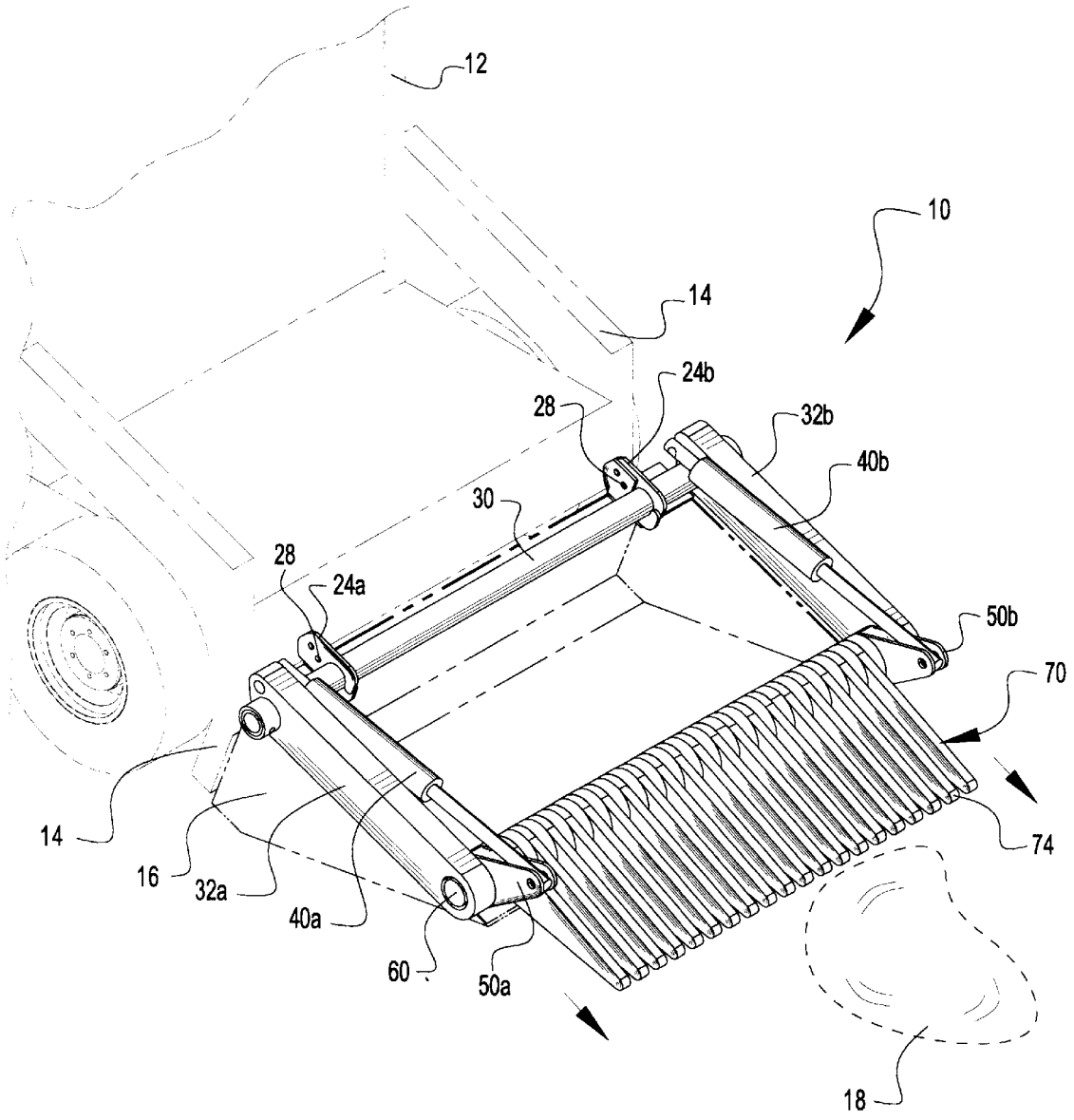
FIG. 1 is an upper perspective view of the present invention attached to a conventional loader bucket with the teeth engaging a rock.

Turning now descriptively to the drawings, in which similar reference characters denote similar elements throughout the several view, FIGS. 1 through 7 illustrate a rock and material loading system 10, which comprises a pair of brackets 20*a–b* attached to the upper rear portion of a loader bucket 16, a pair of lower jaws 22*a–b* attached to the brackets 20*a–b*, a pair of upper jaws 24*a–b* pivotally attached to the lower jaws 22*a–b*, an upper shaft 30 securable within the jaws, a pair of side arms 32*a–b* pivotally extending from the upper shaft 30, a lower shaft 60 rotatably attached to the distal ends of the side arms 32*a–b*, a plurality of teeth 70 attached to the lower shaft 60, a pair of leverage arms 50*a–b* attached to the lower shaft 60, and a pair of hydraulic cylinders 40*a–b* attached to the upper shaft 30 and to the leverage arms 50*a–b* for manipulating the teeth 70. The user manipulates the hydraulics after engaging an object such as a rock 18 for loading the rock 18 into the conventional loader bucket 16. If the user requires usage of the loader bucket 16 without the invention, the user simply opens the jaws and can easily remove the upper shaft 30 from the jaws thereby allowing unobstructed use of the loader bucket 16.

As shown in FIGS. 1 through 7, a conventional loader bucket 16 comprises a front edge, a pair of side portions, a floor, and a rear portion. A pair of loader arms 14 pivotally extend from a conventional tractor 12. The distal ends of the loader arms 14 are typically pivotally attached to the loader bucket 16 for elevating and lower the loader bucket 16. The user of a conventional tractor 12 and loader bucket 16 operates a hydraulic system for elevating and lowering the loader bucket 16.

Figure 7:
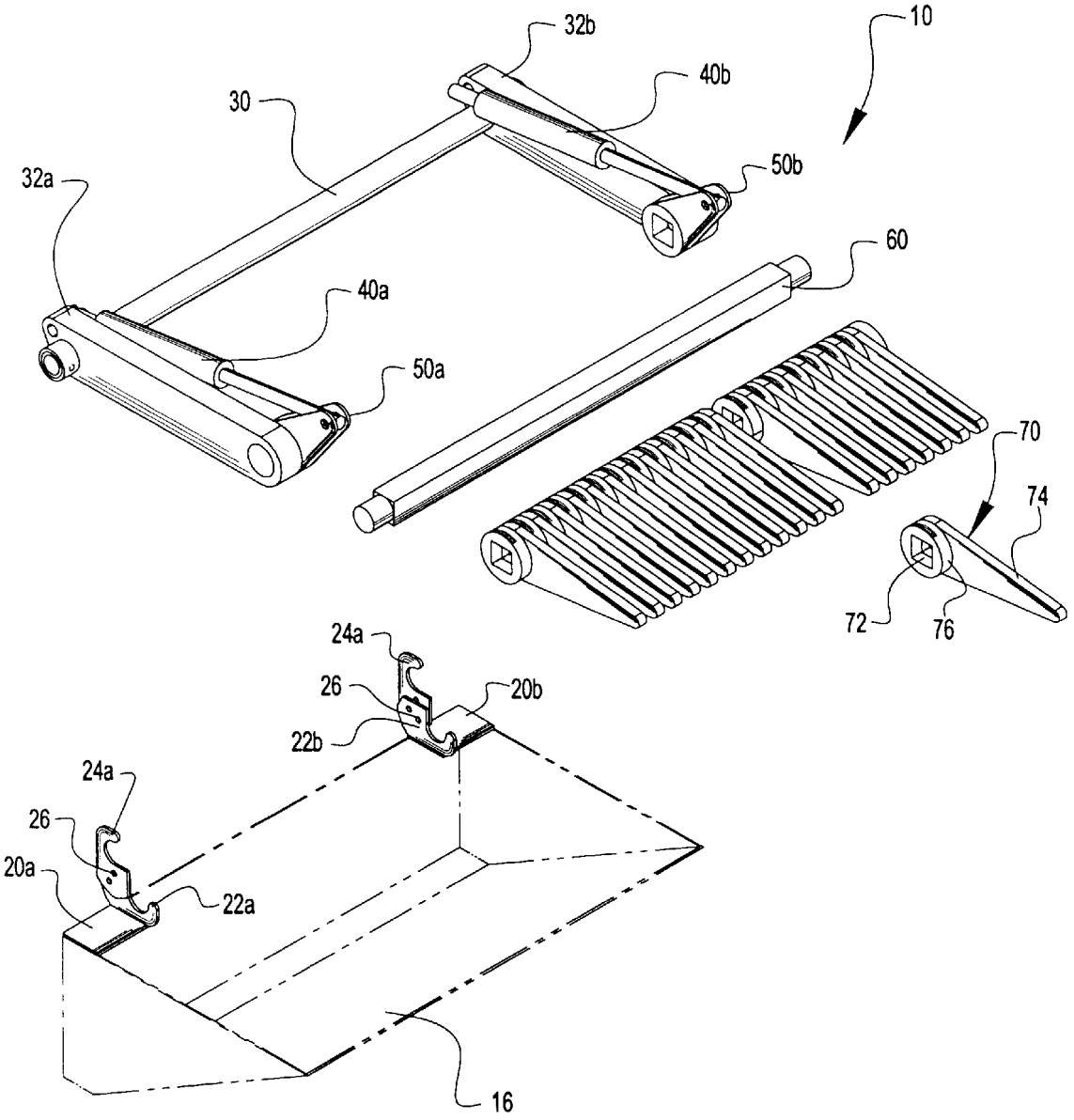
FIG. 7 is an exploded upper perspective view of the present invention with respect to the conventional loader bucket.

As best shown in FIG. 7 of the drawings, a pair of brackets 20*a–b* are secured to the upper portion of loader bucket 16 by conventional means such as welding or fasteners. As further shown in FIG. 7 of the drawings, a pair of lower jaws 22*a–b* are attached to the brackets 20*a–b*. The lower jaws 22*a–b* have a cutout for removable receiving the upper shaft 30. A pair of upper jaws 24*a–b* are rotatably attached to the lower jaws 22*a–b* as further shown in FIG. 7 of the drawings. The pair of upper jaws 24*a–b* both have a cutout that mirror the cutout within the lower jaws 22*a–b*. When the upper jaws 24*a–b* are locked respective to the lower jaws 22*a–b*, the respective cutouts form an enclosed aperture for receiving the upper shaft 30. It can be appreciated by one skilled in the art that the aperture formed by the cutouts within the lower jaws 22*a–b* and the upper jaws 24*a–b* may have any well-known shape such as circular, rectangular or square.

Both pairs of upper jaws 24*a–b* and lower jaws 22*a–b* have a pair of locking apertures 26 as best shown in FIG. 7 of the drawings. A locking pin 28 is removably insertable into each of the locking apertures 26 for retaining the upper jaws 24*a–b* locked about the upper shaft 30 with respect to the lower jaws 22*a–b* as shown in FIG. 1 of the drawings. To remove the invention from the loader bucket 16, the locking pins 28 are removed thereby allowing the upper jaws 24*a–b* to be pivoted upwardly thereby allowing the upper shaft 30 to be removed.

Figure 2:
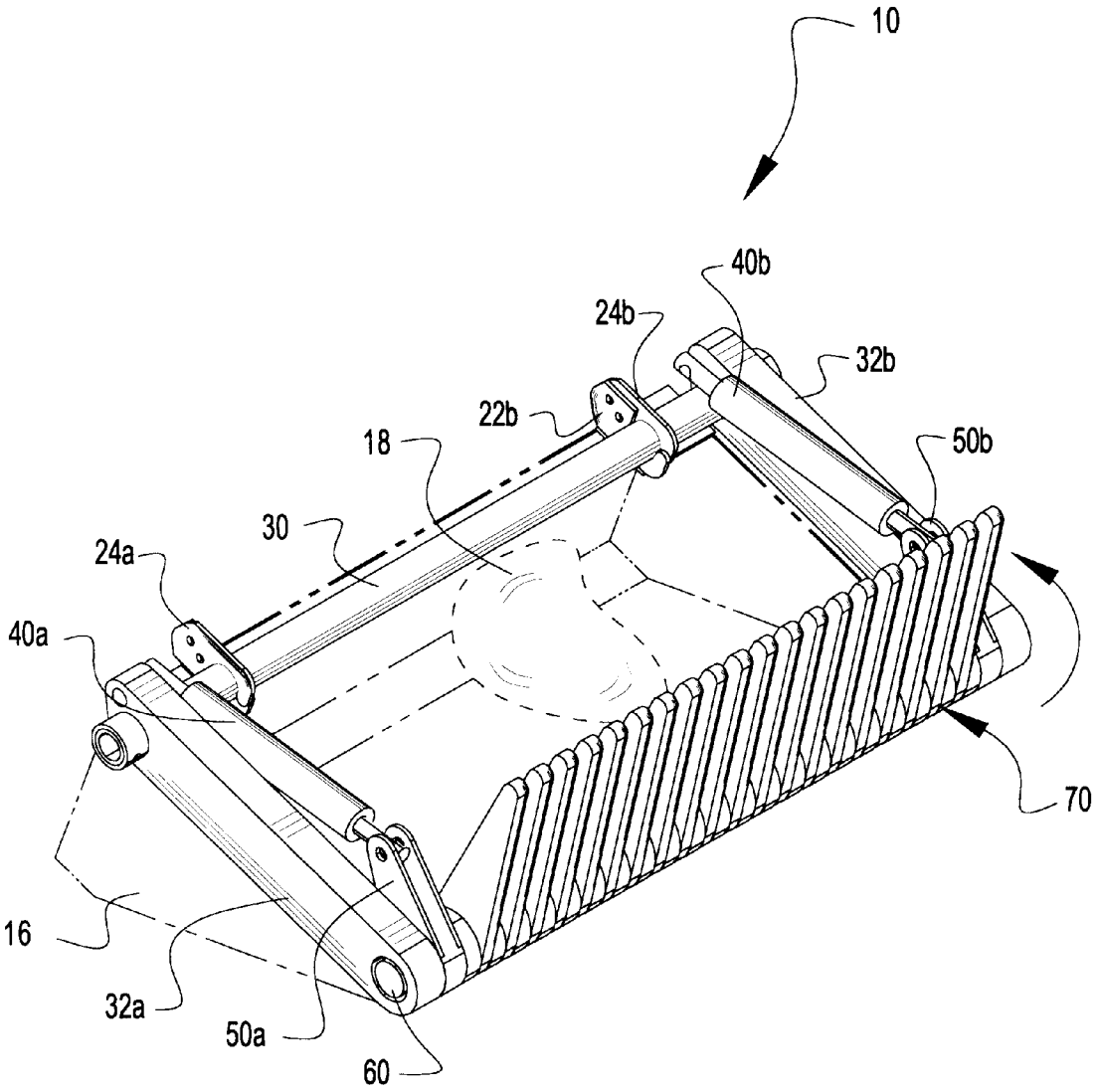
FIG. 2 is an upper perspective view of the present invention showing the plurality of teeth being pivoted for loading the rock.

As best shown in FIGS. 1 and 2 of the drawings, the upper shaft 30 is approximately the width of the loader bucket 16. The upper shaft 30 is preferably tubular for decreasing the overall weight of the present invention. The upper shaft 30 may also have any well-known cross-sectional area such as circular or rectangular. The upper shaft 30 is removably retained between the locked upper jaws 24*a–b* and lower jaws 22*a–b* as best shown in FIG. 1 of the drawings thereby preventing removal of the upper shaft 30 from the loader bucket 16.

Figure 5:
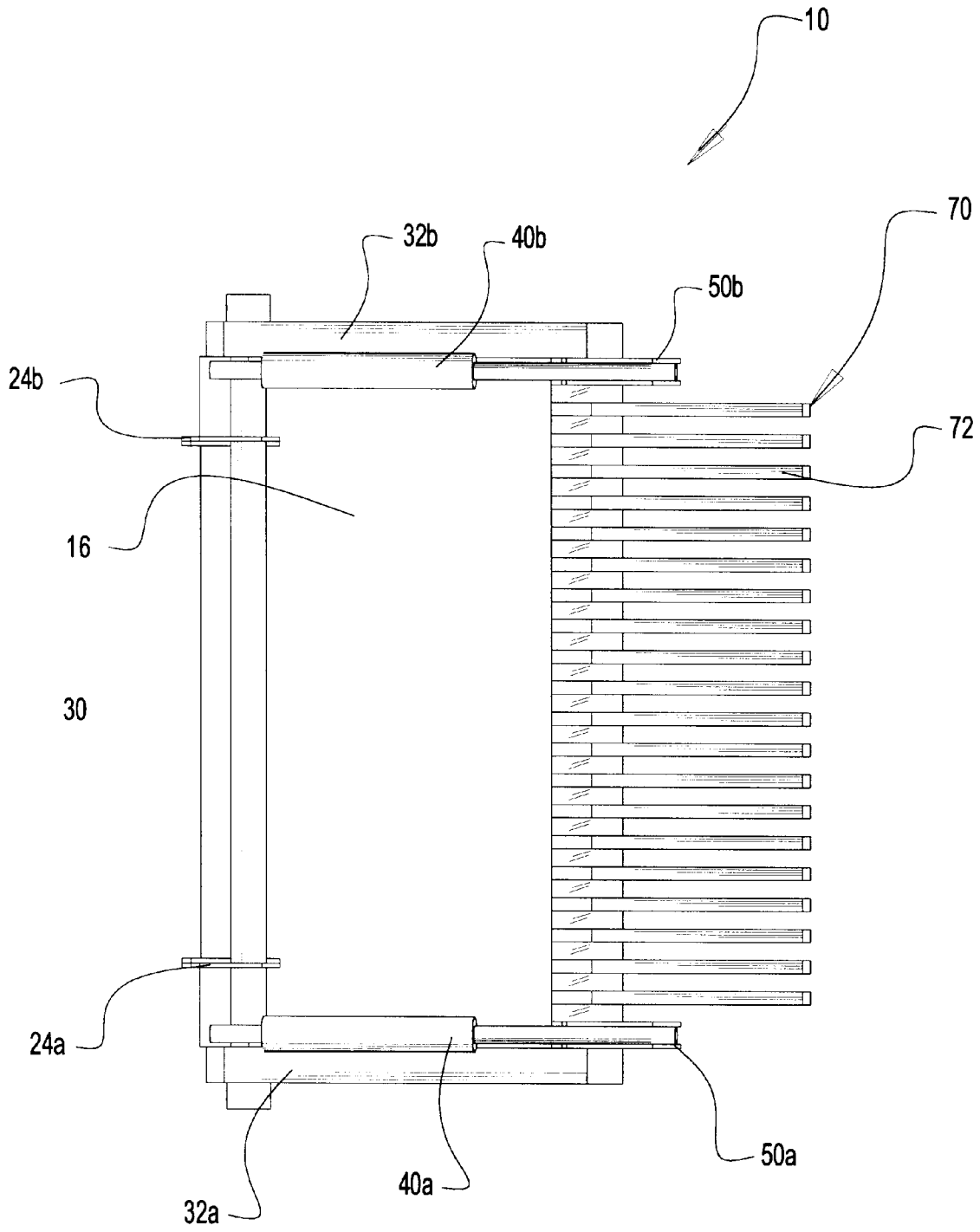
FIG. 5 is a top view of the present invention attached to a loader bucket.
Figure 6:
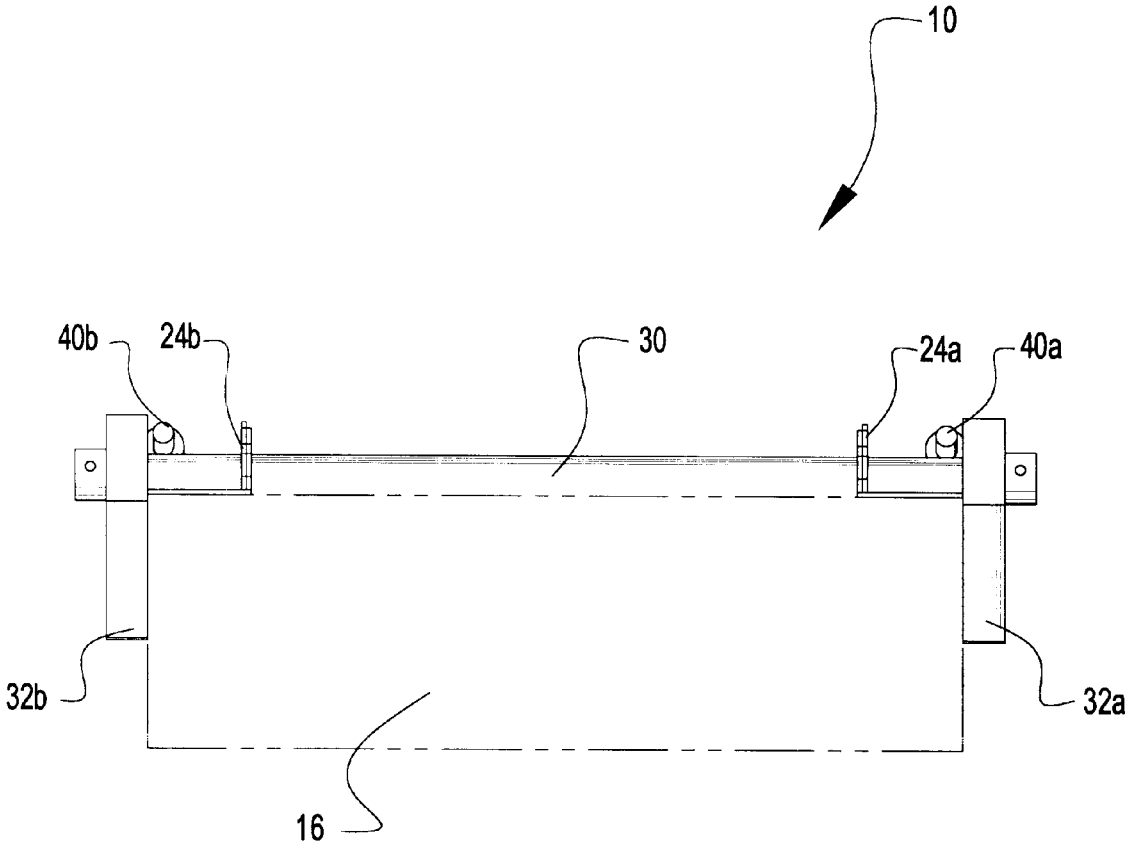
FIG. 6 is a rear view of the present invention attached to a loader bucket.

As best shown in FIGS. 1, 5, and 7 of the drawings, a pair of side arms 32*a–b* are rotatably attached to opposing ends of the upper shaft 30. A pair of bearings or other structure may be utilized within the side arms 32*a–b* for allowing rotation about the upper shaft 30 without significant wearing upon the pair of side arms 32*a–b* and the upper shaft 30. The pair of side arms 32*a–b* are attached to the upper shaft 30 by conventional means for preventing movement upon the longitudinal axis of the upper shaft 30. The pair of side arms 32*a–b* have a length approximately the same as the upper side edge of the loader bucket 16. The pair of side arms 32*a–b* rest upon the side edges and/or the front edge of the loader bucket 16. It can be appreciated that a conventional attachment means can be utilized for securing the pair of side arms 32*a–b* if desired.

As best shown in FIG. 5 and 7 of the drawings, a lower shaft 60 is rotatably attached to the lower distal ends of the side arms 32*a–b*. The lower shaft 60 is preferably positioned adjacent a portion of the front edge of the loader bucket 16 and extends a finite distance above the front edge of the loader bucket 16 thereby preventing material from escaping the loader bucket 16 such as a rock 18. The lower shaft 60 is approximately the same length as the upper shaft 30.

As best shown in FIGS. 2, 3, 5 and 7 of the drawings, a pair of leverage arms 50*a–b* are attached to the outer portions of the lower shaft 60. The leverage arms 50*a–b* preferably have a U-shaped structure as best shown in FIGS. 1 and 2 of the drawings. A pair of hydraulic cylinders 40*a–b* or other actuators, are mechanically connected between the upper shaft 30 and the leverage arms 50*a–b* for allowing manipulation of the lower shaft 60. The hydraulic cylinders 40*a–b* may also be attached to the side arms 32*a–b* instead of the upper shaft 30 as can be appreciated. The hydraulic cylinders 40*a–b* are fluidly connected to the hydraulic system of the tractor 12 which is well-known and will not be discussed.

As best shown in FIG. 7 of the drawings, a plurality of teeth 70 are removably attached about the lower shaft 60 parallel to one another. Each of the plurality of teeth 70 preferably have a tapered structure having a narrow end 74 at the distal portion. Each of the teach includes a spacer member 76 for allowing proper spacing between the teeth 70. An attachment aperture 72 extends through the broad portion of each of the teeth 70 for being positionable about the lower shaft 60. The attachment aperture 72 preferably has a rectangular shape that corresponds to the cross-section of the lower shaft 60 for preventing rotation of the teeth 70 about the lower shaft 60.

Figure 3:
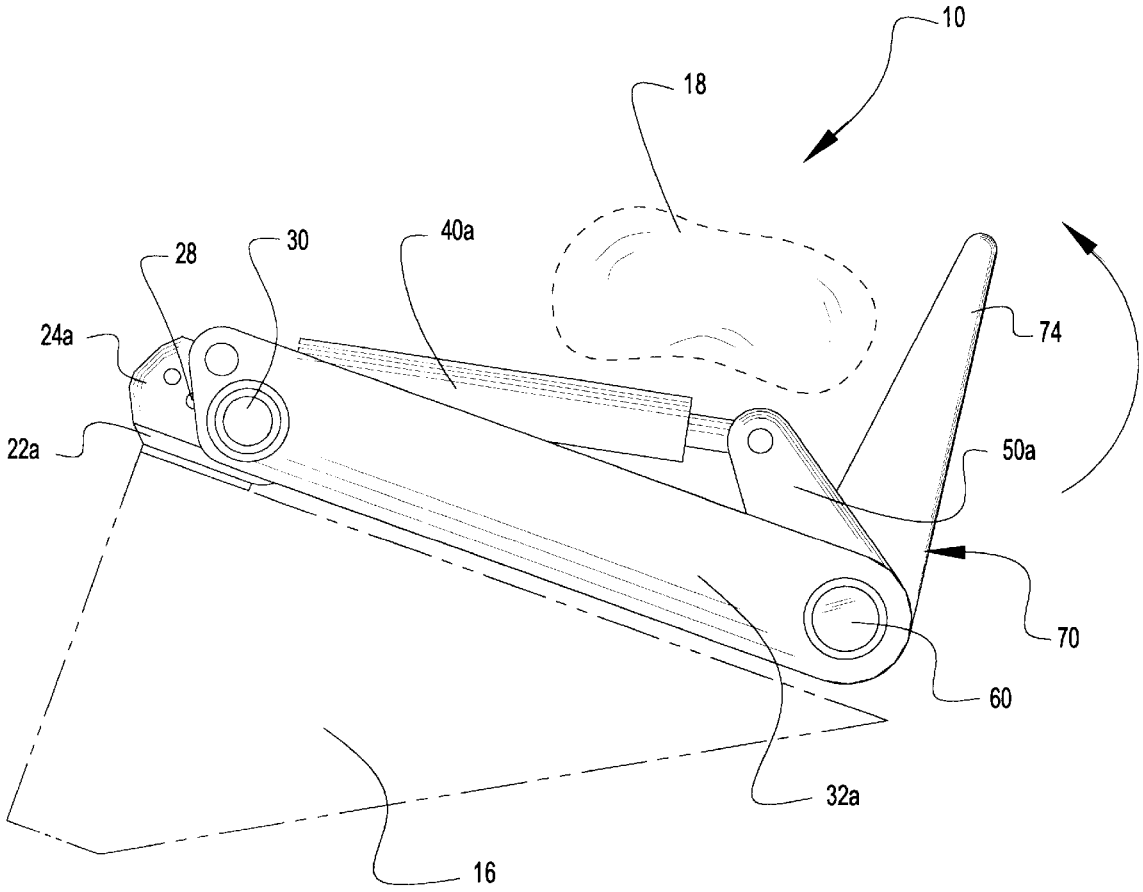
FIG. 3 is a side view of the present invention loading the rock.
Figure 4:
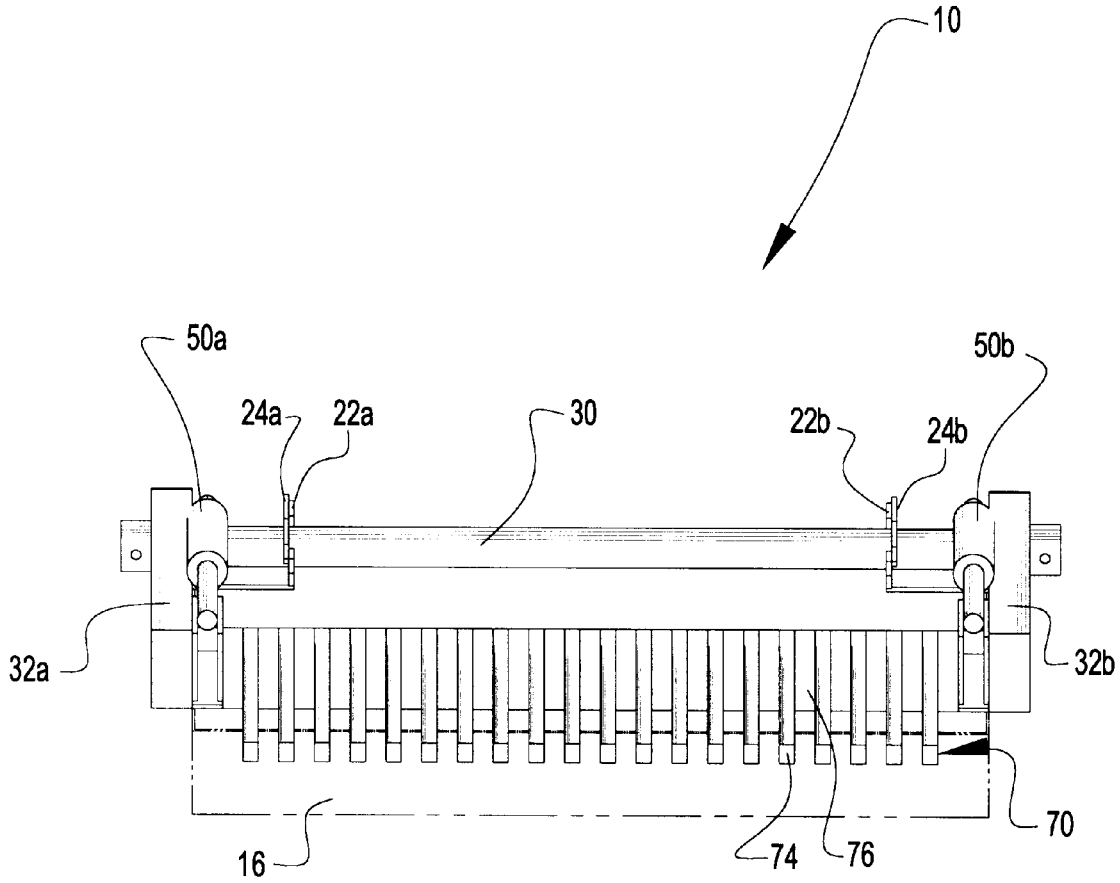
FIG. 4 is a bottom view of the present invention attached to a loader bucket.

In use, the user operates the tractor 12 within the field as normal. The user approaches a rock 18 with the teeth 70 substantially in a horizontal position. The use moves the tractor 12 forward so that the rock 18 is elevated upon the teeth 70 as shown in FIG. 1 of the drawings. The user then actuates the hydraulics within the tractor 12 for manipulating the hydraulic cylinders 40*a–b* thereby rotating the teeth 70 and the rock 18 toward the interior of the loader bucket 16 as shown in FIGS. 2 and 3 of the drawings. After the rock 18 is manipulated into the interior of the loader bucket 16, the user lowers the teeth 70 so that they are parallel to or angled into the ground surface as shown in FIG. 1 of the drawing. This process continues until the user has a full load within the loader bucket 16. The user then may deposit the material into a trailer, truck or upon a rock pile. To deposit the rock 18, the user simply elevates the bucket and tilts the loader bucket 16 so that the rock 18 within is forced toward the front edge of the loader bucket 16. The pair of side arms 32*a–b* and lower shaft 60 are generally pivoted upon the upper shaft 30 thereby allowing the rock 18 within to easily pass from the loader bucket 16 over the front edge. After the loader bucket 16 is emptied, the user returns the loader bucket 16 to its original position thereby causing the side arms 32*a–b* to be positioned adjacent the upper edge of the loader bucket 16. The user is then free to continue picking rocks 18 as stated above. If the user requires use of the loader bucket 16 without the present invention, such as for removing a large rock 18, the user simply removes the pins from the jaws 22*a–b*, 24*a–b* thereby allowing easy removal of the invention without the assistance of another. When finished, the user then repositions the upper shaft 30 within the jaws 22*a–b*, 24*a–b* and then inserts the locking pin 28 into each locking aperture 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Rock and Material Loading System
ENVIRONMENTAL ELEMENTS

10. Rock and Material Loading System
11.
12. Tractor
13.
14. Loader Arms
15.
16. Loader Bucket
17.
18. Rock
19.
20. Brackets (a-b)
21.
22. Lower Jaws (a-b)
23.
24. Upper Jaws (a-b)
25.
26. Locking Aperture
27.
28. Locking Pin
29.
30. Upper Shaft
31.
32. Side Arms (a-b)
33.
34.
35.
36.
37.
38.
39.
40. Hydraulic Cylinders (a-b)
41.
42.
43.
44.
45.
46.
47.
48.
49.
50. Leverage Arms
51.
52.
53.
54.
55.
56.
57.
58.
59.
60. Lower Shaft
61.
62.

-continued

| Index of Elements for Rock and Material Loading System<br>ENVIRONMENTAL ELEMENTS |
|---|
| 63. |
| 64. |
| 65. |
| 66. |
| 67. |
| 68. |
| 69. |
| 70. Teeth |
| 71. |
| 72. Attachment Aperture |
| 73. |
| 74. Narrow End |
| 75. |
| 76. Spacer Member |
| 77. |
| 78. |
| 79. |

I claim:

1. A rock and material loading system that is attachable to a loader bucket of a tractor, comprising:

a securing means attachable to an upper portion of said loader bucket;

an upper shaft attachable within said securing means;

a pair of side arms rotatably attached to said upper shaft;

a lower shaft rotatably attached between said pair of side arms;

a plurality of teeth extending from said lower shaft; and an actuator means extending between said upper shaft and said lower shaft for allowing selective rotation of said actuator means.

2. The rock and material loading system of claim 1, including at least one leverage arm attached to said lower shaft and receiving said actuator means.

3. The rock and material loading system of claim 2, wherein said securing means comprises:

a pair of lower jaws; and a pair of upper jaws pivotally attached to said lower jaws.

4. The rock and material loading system of claim 3, wherein said lower jaws and said upper jaws have a locking aperture that receives a locking pin for locking said upper jaws with respect to said lower jaws.

5. The rock and material loading system of claim 4, wherein said plurality of teeth are removably attached about said lower shaft.

6. The rock and material loading system of claim 5, wherein said plurality of teeth taper toward the distal ends.

7. The rock and material loading system of claim 6, wherein each of said plurality of teeth include an attachment aperture for being positioned about said lower shaft.

8. The rock and material loading system of claim 7, wherein said attachment aperture has a rectangular shape similar to a cross-section of said lower shaft for preventing rotation of said plurality of teeth during use.

9. The rock and material loading system of claim 8, wherein each of said plurality of teeth include a spacer member for providing a finite space between each of said plurality of teeth.

10. The rock and material loading system of claim 9, wherein said actuator means comprises at least one hydraulic cylinder.

11. A rock and material loading system that is attachable to a loader bucket of a tractor, comprising:

a securing means attachable to an upper portion of said loader bucket;

an upper shaft attachable within said securing means;

a pair of side arms rotatably attached to said upper shaft;

a lower shaft rotatably attached between said pair of side arms;

a plurality of teeth extending from said lower shaft; and an actuator means extending between at least one of said side arms and said lower shaft for allowing selective rotation of said actuator means.

12. The rock and material loading system of claim 11, including at least one leverage arm attached to said lower shaft and receiving said actuator means.

13. The rock and material loading system of claim 12, wherein said securing means comprises:

a pair of lower jaws; and a pair of upper jaws pivotally attached to said lower jaws.

14. The rock and material loading system of claim 13, wherein said lower jaws and said upper jaws have a locking aperture that receives a locking pin for locking said upper jaws with respect to said lower jaws.

15. The rock and material loading system of claim 14, wherein said plurality of teeth are removably attached about said lower shaft.

16. The rock and material loading system of claim 15, wherein said plurality of teeth taper toward the distal ends.

17. The rock and material loading system of claim 16, wherein each of said plurality of teeth include an attachment aperture for being positioned about said lower shaft.

18. The rock and material loading system of claim 17, wherein said attachment aperture has a rectangular shape similar to a cross-section of said lower shaft for preventing rotation of said plurality of teeth during use.

19. The rock and material loading system of claim 18, wherein each of said plurality of teeth include a spacer member for providing a finite space between each of said plurality of teeth.

20. The rock and material loading system of claim 19, wherein said actuator means comprises at least one hydraulic cylinder.

* * * * *